US007395666B2

(12) United States Patent
Miroslav

(10) Patent No.: US 7,395,666 B2
(45) Date of Patent: Jul. 8, 2008

(54) THERMAL HYDRO-MACHINE ON HOT GAS WITH RECIRCULATION

(76) Inventor: Rak Miroslav, Sandora Petefija 176, Osijek (HR) 31000

( * ) Notice: Subject to any disclaimer, the term of this patent is extended or adjusted under 35 U.S.C. 154(b) by 0 days.

(21) Appl. No.: 10/593,228

(22) PCT Filed: Feb. 3, 2005

(86) PCT No.: PCT/HR2005/000011

§ 371 (c)(1),
(2), (4) Date: Sep. 18, 2006

(87) PCT Pub. No.: WO2005/090770

PCT Pub. Date: Sep. 29, 2005

(65) Prior Publication Data

US 2007/0186554 A1 Aug. 16, 2007

(30) Foreign Application Priority Data

Mar. 19, 2004 (HR) ..... P 20040269 A

(51) Int. Cl.
*F01B 29/10* (2006.01)

(52) U.S. Cl. ..... 60/517; 60/645

(58) Field of Classification Search ..... 60/517, 60/643, 645

See application file for complete search history.

(56) References Cited

U.S. PATENT DOCUMENTS

| | | | | |
|---|---|---|---|---|
| 4,392,351 | A | 7/1983 | Doundoulakis et al. | |
| 4,520,632 | A * | 6/1985 | Dibrell | 62/403 |
| 5,680,768 | A * | 10/1997 | Rattray et al. | 62/6 |
| 6,532,748 | B1 | 3/2003 | Yuan et al. | |
| 6,812,601 | B2 * | 11/2004 | Gamble et al. | 310/52 |
| 7,174,721 | B2 * | 2/2007 | Mitchell | 62/6 |

FOREIGN PATENT DOCUMENTS

WO WO 82/04098 A 11/1982

OTHER PUBLICATIONS

International Search Report (PCT/HR2005/000011).

* cited by examiner

*Primary Examiner*—Hoang M Nguyen
(74) *Attorney, Agent, or Firm*—Kalow & Springut LLP

(57) ABSTRACT

A thermal hydro-machine on hot gas with recirculation (FIGS. 3, 4 and 5) belongs to the group of multi-cylinder piston rotational machines for converting the heat into the mechanical work. The heat is conducted to on the outer side of one part of rotational tubular heat exchanger (1) and is simultaneously conducted away from the other part of same exchanger (1). The exchanger is composed of a set of independent segment collectors (1) arranged in the form of a cylindrical shell, made pair wise with a set of independent segment cylinders with free pistons (2) in which there is the independent gas under pressure.

9 Claims, 3 Drawing Sheets

SECTION "A-A"

THERMAL HYDRO-MACHINE ON HOT GAS WITH RECIRCULATION

FIELD OF TECHNIQUES TO WHICH THE INVENTION IS RELATE

The invention belongs to the group of plants of volumetric engines on hot gas for the conversion of the thermal energy into the mechanical work, with the notation F 02 G 1/04 (subgroup 1/043 or 1/044) according to IPC (1994.). The conducting-to of the thermal energy is foreseen along the outer side of a greater number of heated cylinders or collector exchangers (subgroup 1/044), transmitting it on to the compressible working fluid (gas), independent in each cylinder under pressure in the closed cycle process. The work of the thermal hydro-machine is enabled by the mass expansion and compression of the working fluid (the gas), which is heated and cooled (subgroup 1/047) simultaneously in several independent cylinders, transmitting the work on the free axially pressed working pistons (or on the membranes, alternatively). The piston motion is linear and reversible, must often parallel with the main shaft (it can also have some other position as, for example, perpendicular or inclined to the main shaft), which together with the cylinders, and by means of the cooperative members achieve the auxiliary relative rotational motion about the main shaft.

According to the idea concept, it is based on the key mainly isothermal principle of the expansion and compression of the working medium, which is among other state changes represented in the right-turning closed working cycle. We recognise them as the so-called "isothermal" working cycles, which according to their authors appear in the literature under the name: the Carnot, Stirling, Ericsson, Reitlinger, Ackert-Keller cycle, depending on the other state changes cycle and on the way of conducting-to and -away the heat.

As in the mainly isothermal working cycle of this invention a new combination of non-isothermal state changes is encountered, which cannot be recognised in the individual indicated typical examples of the known practice; this working cycle is unique, conditioned by a new type constructional solution of the thermal machine. Therefore, this is a new original way of the thermodynamic heat conversion into the mechanical work, which opens new possibilities of progress, improvement and classification of volumetric machines on hot gas. By introducing the secondary medium (the recirculation incompressible medium-liquid) on the other side of the pistons, as a secondary work transmitter in the form of the closed recirculation hydrodynamic flow in the hydraulic part of the machine, the construction can be classified in the general undefined group of complex volumetrically-circulating, piston-turbine engines or propulsion machines with the notation F01B, F01C and F01D according to IPC (1994.). In group F026 1/04, the "circulation" way of work is not indicated, which is characteristical for the secondary hydrodynamic flow in the turbine of the complex propulsion machine (plant), so that even this notation does not classify the invention completely.

Technical Problem

The technical problem solved by this invention is the conversion of the thermal energy into the useful mechanical work, presented by an original, mixed right-turning circular cycle. The thermodynamic cycle, which is the base of this type thermal machine, originated from the combination of the present known cycles, in which the isothermal state changes and the mixture of other theoretical state changes are predominant, which cannot be found in any of the known individual ideal working cycles, mainly due to the way of the heat conducting-to and -away.

Generally, the conversion of the thermal energy into the mechanical work is possible in many ways. From the theoretical right-turning thermodynamic cycles, the most important one is Carnot cycle (1824.) with two isothermal and two adiabatic state changes. This ideal thermodynamic cycle is anticipated with the ideal construction of the thermal machine having four cylinders, but unfortunately it has never been realised in the practice, although even today it has an invaluable theoretical significance for the development of thermal machines and the comparative evaluation of real cycles.

The equivalent to the Carnot cycle is the Stirling thermal cycle (1871.), anticipated in the closed system between two isotherms and two isochors. As a difference to the Carnot cycle, it has been realised in the one-cylinder machine on hot air (1816.) a long time before than it has been completely theoretical explained. The basic Stirling construction experienced an interminable line of constructional solutions and improvements, and the present invention partially is based on that initial solution, so it will be explained in more details in the continuation. It is also much worthy to pay an attention to the Ericsson cycle (1853.), anticipated between two isotherms and two isobars with the hot air as the working gas in an open system and using the regenerator in the form of a thermal sponge. In practice it is realised with two cylinders and the regenerator. Similar to it is also the Reitlinger cycle (1873.), which is also based on two isotherms as a most convenient state change and two polytropes for achieving the greatest work together with the application of that characteristic assembly of the thermal regenerator. In practice, it is realised with two cylinders and the regenerator. If in the Carnot cycle the adiabatic state change is replaced by the isobars, then the theoretical Ackert-Keller cycle with two isotherms and two isobars is obtained. It is anticipated in the constructional engine realisation with two cylinders and the exchanger's assembly in the big thermal container. This construction is not realised in practice, so the cycle has only a theoretical significance. This theoretical cycle has some similarity with the cycle on which this invention is based, and they differ in one state change where the isochors replaces the isobar, but the essential difference is in the way of the heat conducting-to and -away, the state change velocity and the process continuity.

For all indicated unrealised and in practice realised right-turning circular cycles it is characteristic and common, that they in their basic version contain two isothermal state changes. These, in combination with two another equal or with more different non-isothermal state changes, form the cycle, which substantially almost regularly contains the accumulation and regeneration of the heat and theoretically promises the achieving of the greatest useful work.

At solving the technical problem by means of this invention, it has been started from the fact that the future thermodynamic cycle of the new construction of the thermal machine must also contain two approximately isothermal state changes, which in combination with at least two differently achievable non-isotherm state changes will determine the type of the constructional solution in practice. Here also at this invention, at the non-isothermal state changes, the necessary accumulation and regeneration of the heat energy is achieved, but in the form of the hydrodynamic circulation of the secondary medium, thus without introducing the additional characteristic assemblies for storing the heat energy, which are rationalized by achieving a plurality of replacing function elements of the existing assemblies.

For the practical presentation of the technical problem the realised Stirling cycle (1871.) with pistons is suitable, which is based on the hot and cold cylinder, which pistons are in the basic realisation fixed on the same shaft with an angular phase shift. By that it is achieved, that the same working gas firstly mainly expands from the hot space, then by the distributor is transferred into the cooled (part of the) cylinder and is compressed mainly in the cooled space. Due to the fact that by the expansion of the hot working gas more work is obtained than consumed by the compression of the cold gas, the difference makes the useful work between the rigidly connected pistons on the machine main shaft. The disadvantage of such a solution is that because of the angular phase shift between the expansion and compression it is never achieved that the entire working gas is hot or alternatively cold, but the mixture of hot and cold gas takes part in the thermodynamic cycle. Therefore, the gas mixture gives less work at the expansion and consumes more work at the compression, so that the process is at both sides aggravated. By the newer constructional solutions without the piston, the drawback created due to the angular phase shift and the rigid connection was overbridged by the distributor, which has periodically abruptly transferred the entire working gas from the hot into the cold space, and in such a way has participated in the process only either as the hot one or as an alternatively cold one. On this basis a partially greater useful working difference on the engine shaft is obtained, but additionally a more complex system of levers for the periodically gas distribution is introduced. Anyhow, in spite of the improvements, the essential drawback of the solution of the technical solution remained; this is the discontinuity of the process of the conversion of the thermal energy into the mechanical work, which is conditioned by the heat conducting-to and -away from the immovable cylinders in the hot and cooled space.

In practice it is not possible to achieve the continuous pure isothermal state changes in a real cycle, therefore the constructors have searched for the solution of the general technical problem a simple but efficient type constructional solution, by which the desired goal would at least be approached, and have added various technical improvements that have in the rule complicated the construction. The introduction of necessary additional thermally characteristic assemblies and devices such as distributors, regenerators or heat batteries has in the theoretical sense meant the equalisation of the effect of the indicated closed cycles (Stirling, Ericsson, and Reitlinger) with the Carnot cycle, but in practice it was not like that. The introducing of additional characteristic assemblies has in practice only partially and of limited range improved the quality of the realised cycle, but has additionally complicated the construction, what deviates from the long time known basic principle of the construction simplicity. Due to the fact that in reality there is no complete heat exchange, in spite of the additionally built improvement constructional assemblies, the purely isotherm state changes and the total heat regeneration is not achieved, so that the present type constructions have the thermodynamic drawbacks. The main problem is, that the discontinuity between the heat conducting-to to the working cylinder and the expansion of the work gas exists, as well as between the heat conducting-away from the working cylinder and the compression of the work gas, which at the present classical constructions is conditioned by the speed of change of the distributed gas, the angular phase shift between the rigidly connected pistons and by the cylinder static in relation to the heat conducting-to in the hot space and the heat conducting- away in the cooled space. So, in practice the expansion of the working fluid in the immovable cylinder does not last in the same time during the heat conducting-to period, and also the compression does not last in the same time during the heat conducting-away period from the immovable cylinder, what inevitably conditions the additional building of the characteristic assemblies for the heat accumulation and regeneration. This has as a consequence the reduced efficiency of the thermal machine or, more directly, a lower useful work. In spite of the indicated improvements of the type constructions, the main technical problem has remained, and that is the so often pointed-out discontinuity of the thermodynamic cycle, which consists in the fact that the change of the expansion and compression state in reality lasts shorter than the continued heat conducting-to or -away to the immovable cylinders. A quicker state change substantially corrects the isothermal expansion and compression into the polytrops with a lower effect of the useful work. This lack of duration coordination of the essential state changes of the same working fluid of the achieved cycle, in spite of the simultaneous heat conducting-away and -to to the working cylinders, is still an unbridgeable drawback of the present solutions. In such a way, on the basis of the indicated thermodynamic principles, the technical problem of the thermal energy conversion into the mechanical work has been solved on innumerable type constructional variants, and it is continued even today with more or less success.

Analysing the theoretical cycles that are realised in the practice in one, two or more immovable cylinders with the same distributed working gas, an important question poses itself: can such a thermal machine be constructed, in which the classical expansion cylinders will be replaced by a plurality of independent mobile cylinders with the independent working fluid to which the heat will be conducted simultaneously, and the classical compression cylinder replaced by a plurality of mobile cylinders with the independent working fluid from which the heat will be conducted away simultaneously? If this is possible, and substantially there are no difficulties about it, then the connection between the independent expansion and compression towards the working shaft cannot stay rigid as it is at present (the crank shaft or the rigid mechanical mechanism), but it must be an adjustable connection such as for example the hydrodynamic flow of the secondary incompressible medium. Another important question poses itself: is it possible to remove partially or completely the distributors, heat batteries or regenerators, by means of which the same working fluid is distributed or transferred alternately, in order to enable or improve the cycle? The answer is also affirmative, if it goes about a plurality of separate contents of the primary working fluid in the independent cylinders, which are, each separately, gradually and relatively slowly transferred from the hot into the cooled space, instead of the present way of distributing and transferring the working gas via the heat battery or regenerator. In such a way, the entire conducted-to and the entire conducted-away heat would almost simultaneously isothermally exchange with the working fluid that takes part in a certain phase of the cycle, either the expansion or the compression. According to these requirements, by this invention such a thermal machine will be constructed, which by the idea represents a new, simple and technically realisable solution. With it, the theoretical cycle is approached in the best possible way and the general technical problem of the heat conversion into the useful mechanical work is being solved.

The technical problem of unrealised and realised right-turning thermodynamic cycles is to find a new technical solution of the type construction of the thermal machine, by means of which the heat would be converted in the easiest and simplest way, at highest efficiency, into the mechanical useful work. It is possible to solve the technical problem by satisfying and achieving several strategically essential thermodynamic and technologically-constructional requirements such as:

- to approach the expansion temperature of the working fluid as much as possible to the temperature of the heat source, and to approach the compression temperature of the working fluid as much as possible to the temperature of the cooled space (surrounding);
- to eliminate the discontinuity of the state change between the expansion and compression, created as a consequence of the angular phase shift of the working and distribution piston, which are usually rigidly connected to the same shaft or are connected by the rigid driving mechanical connection;
- to increase the expansion time to reach almost the time of the heat conducting-to, and to increase the compression time to reach almost the time of the heat conducting-away;
- to heat maximally or, alternately, to cool maximally the entire compressible fluid at the shortest possible non-isothermal state changes in the cycle, and in such a way to self-regenerate the greatest part of the heat without introducing the additional characteristic assemblies, heat batteries or regenerators;
- to enable a continuous and relatively slow change of the expansion state during the entire time of the heat conducting-to, and a continuous and relatively slow change of the compression state during the entire time of the heat conducting-away, by which the isothermal continuity is achieved;
- to increase maximally the positive expansion work by a greatest possible compression ratio, and to reduce the negative compression work to the least possible measure, what would mean the increase of the useful work and an additional efficiency improvement of the thermal machine;
- to adjust the construction of the exchanger's assembly (of the cylinder) by the durability, size and shape to the kind of heat source or the cooled space (the surroundings), in order
- that the entire disposable heat, almost without losses, would be transferred onto the working fluid or from it given to the cooled space, i.e. the intensity of the heat exchange would increase;
- to achieve, by increasing the relation of the working pressure and the density, i.e. by increasing the mass of the compressible working fluid in the closed system, the possibility of accepting or delivering a greater amount of the heat and in such a way to reduce the machine dimension.

State of Art

All thermal machines with the external heat conducting-to work today on the principle of the regenerative thermodynamic cycle, in which the same working fluid successively primarily expands and secondary compresses at different temperature levels. The useful mechanical work is achieved as the difference of the obtained work by expansion on a higher temperature level and the consumed work by the compression at a lower temperature level.

The designers of the thermal machines have tried by various constructional variants to imitate the today known theoretical right-turning cycles with more or less success, such as for example the Carnot, Stirling, Ericsson, Reitlinger, Ackert-Keller, et all, according to whom they have obtained the names. One of the best known, the Carnot theoretical cycle, stayed only on the level of the theoretical considerations, because it was never realised in practice. It is known as a demonstrative theoretical cycle with the highest thermodynamic efficiency grade, according to which the others were compared. Therefore, efforts were made in seeking the constructional technical solutions according to the indicated equivalent thermodynamic cycles, such as, for example, the Stirling one. So, the Stirling cycle could have been realised very easily already with only one working cylinder, while the Carnot cycle could not even with four ones. The realised equivalent cycles still have not experienced a mass application due to the practical drawbacks, which could not been eliminated at all or only partially. Therefore, even the efficiency grade of the simpler practical technical solutions was not satisfactory, while those more complex ones, with the additional characteristic assemblies and a better efficiency grade, extended the level of the commercial mass production.

All present, Stirling constructions are made in a way that the heat is externally conducted to the immovable cylinder, and the pistons produce the motion under the expansion of the working gas, transmitting the work onto the shaft. At that, the heat is conducted directly to the distribution cylinder or indirectly via the hot heat exchange, and is conducted away directly from the cooled part of the distribution cylinder or indirectly via the cooled heat exchanger. By introducing the heat exchanger and by connecting with the distribution cylinders in the hot and cooled space, this is only an improvement measure by which the area for a more intensive heat exchange is increased. This technical measure will have only the limiting effect on the heat conversion into the mechanical work, because the conversion depends on the speed and on the adjustment of the state changes in the cycles with the way of the heat conducting-to or -away. In the very beginning the Stirling machine consisted of one distribution cylinder, the distribution piston in the distribution cylinder and one working cylinder with the working piston. By means of the distribution piston the gas was transferred from the hot space into the cooled space of the distribution cylinder, which was connected with the working cylinder and working piston. Both pistons were rigidly connected on the same working shaft and having an angular phase shift. The heat conducting-to or the conducting-away has been done continuously, and the same process of the heat conversion into the mechanical work was discontinued, because it was performed alternately in phases, what was the consequence of the angular phase shift between the distribution and working piston. Due to this, the thermodynamic process became worse. By the more up-to-date constructions it has been achieved, that the entire working gas is only alternately hot or only alternately cold, and in such a way the efficiency grade has improved to a certain level. It remained the main problem of the discontinuity, because of the heat conducting-to or conducting-away way and the state changes of the same distributed working gas, what is the necessity for such a type of construction of the thermal machine. The process discontinuity consisted in the fact, that the expansion of the working gas does not last during the entire period of the intensive heat conducting-to, and the compression of the working gas does not last during the entire cooling time, because the same working gas is alternately entirely transmitted one moment into the hot part of the cylinder and the next moment into the cold part of the cylinder. This discontinuity problem is only partially alleviated by introducing the accumulation on the hot side of the cylinder itself, which takes the heat from the source during the compression or by the intensive under cooling of the cylinder other side during the expansion. In such a way, the basic principle is not satisfied, i.e. the heat conversion into the work in a simplest way by such an intensity that is offered by the source, without the additional, even simpler characteristic devices, the accumulation, the distributor, the heat regenerator or the system of mechanical levers.

By the development and improvement of the classical type of the Stirling machine the characteristic assemblies are additionally built, such as the high-efficiency heat exchanger, the gas distributors, the heat regenerators, the lever mechanism for the work transmission and/or the achievement of the rigid connection between the expansion and the compression, what gave a limited efficiency range. On the other side, the additionally built characteristic assemblies have complicated the construction; therefore it became expensive and unacceptable for the mass application in practice. In the beginning, the classical constructions of the Stirling machine consisted of five characteristic assemblies, such as: the working piston, the cold and hot exchanger, the distributor and the regenerator. Then the number of the characteristic assemblies was rationalized to only three, by connecting several fictions of some elements into the common whole, what simplified the construction but opened new problems, which have reflected in the reduced system extensity.

Presentation of the state-of-art (according to literature "Mobile power of the fire three centuries of the thermal machines" by the author Davor Fulanović—Ivo Kolin; edition Technical museum Zagreb; Croatia 1999.)

Papin (1690.)-Sovary (1698.)

The thermal hydro machine with recirculation has some similarities with the miner's steam pump that was patented by Thomas Sovery (1698) and is based on the atmospheric steam machine by Papin (1690). The miner's steam pump consisted of two water pressurized working vessels and the steam boiler as the source and battery of the heat. One of the vessels would be heated by the direct steam conducting-to from the boiler, achieving the (expansion) fore-pressure by pressing the water via a pair of non-return valves, while in the same time the other vessel would cool abruptly achieving the (condensing) under pressure, sucking-in the water also via the other pair of non-return valves. This simultaneousness is an essential similarity in the thermodynamic sense with the registered construction. The vessels would work alternately in periodic time distances, achieving in the same time firstly the pressing and then the sucking effects, which, although adjusted with the steam expansion and condensation, did not have the features of an entirely continuous cycle, before all because of the small number of vessels, the way of the heat conducting-to or the cooling and the interruption of the flow continuity. The steam boiler, as a heat accumulator and an additional characteristic assembly, has increased the construction complexity, which has influenced not only the price but also the efficiency of the machine with a small efficiency grade.

At the invention proposed in this patent application, a plurality of mobile, independent partial cylinders is introduced, which actually replace the stable pressure vessels of the steam miner's pump. In the cylinders the almost isothermal partial expansions and compressions of the compressible working fluid alternate relatively slow, gradually and continuously, overlapping in the same time during the entire period of the indirect heat conducting-to or conducting-away via the heat exchanger. In such a way, to the thermal cycle the characteristic of an almost complete isothermal continuity is given, improved at both sides and adjusted with the potentials of the heat source. Therefore, the steam boiler and/or a reservoir as a heat battery is not necessary for the heat conducting-to, what simplifies the construction, and the natural heat sources with small temperature differences can be directly used from the environment. Instead of the classical system of a pair of non-return valves, which is applied at the miner's steam pump, at this registered patent an original system of directed, reversibly recirculation, reversibly excepting channels and of the turbine vane wheel with the recirculation incompressible medium is applied. The thermal energy is mutually and continuously, without the accumulation and regeneration or delay, immediately converted into the work, and is partially accumulated into a non-thermal form of the continued hydrodynamic circulation energy of the recirculation medium, achieving the rotational mechanical work onto the main shaft of the engine. Just because of that, this thermal hydro machine does not need the classical heat battery or regenerator, because the secondary recirculation medium overtakes this assignment as the catalyst of the process.

Machine on Hot Air—Stirling(1815.)

The first Stirling machine on hot air was very simple with the external heat conducting-to. It had two pistons, the working shorter piston in a smaller separate cylinder and the long piston of a greater surface in the bigger separate cylinder, which have been connected by the same crank-shaft with the angular phase shift of 90°. The long bigger piston had several functions. It served also as the heat battery and regenerator. Due to the fact that it was of 1% smaller diameter than the cylinder, it served in the same time as the distributor for transmitting the working gas from the hot into the cold space of the big cylinder, enabling the realisation of the expansion work in the small cylinder. The useful work on the engine shaft was obtained as the difference of the expansion and compression work on the small piston in the small cylinder. This machine on hot air is improved by transferring the working piston into the same cylinder of the distribution piston (Stirling 1816.). At this constructional variant, a better heat regeneration by means of the distribution piston of a greater surface, which better accepts and gives away the heat, is achieved. It remains the problem that the piston rod of the long piston passes through the centre of the working piston, so that the working piston must have two rods that are, in relation to the latter one, shifted for the angular phase shift of 90°. Beside that, the complex driving mechanism is a serious constructional drawback of this type construction. The great advantage of this machine on hot air is in general the simplicity, the calm and noiseless work, as well as the exploitation possibility of the thermal source of small temperature differences at a minor pollution of the environment. The drawback of this first constructional variant is a small efficiency grade, which can be improved by introducing the new constructional assemblies. They additionally increase the complexity and the costs of the construction, so that there is the question about optimizing the depending parameters of such a thermal machine. But, scientist Gustav Schmidt (1871.) has in details theoretically elaborated the Stirling cycle, proving its equal theoretical value like at the Camot cycle. As the Stirling cycle was practically realised as a difference to the Camot one, but sincerely with a still not adequate efficiency grade, this principle has a future in the development of type thermal machines.

Machine on Hot Air—Stirling(1827.)

The second Stirling engine on hot air is actually a continuation of improving the first constructional variant, to which is added a more perfection regenerator made of a plurality of perforated tin sheets that act as a heat exchanger in both directions. The engine has two bigger cylinders, which heat at one side and cool at the other side. In them, the distribution pistons and the more efficient regenerators for transmitting the working gas from the hot into the cooled space are placed, giving the expansion work at both sides of the double-working piston, but also consuming the compression work at both sides of the working piston. Also at this constructional variant, the complexity of the construction is in a significant measure increased by a mild but limited increase of the efficiency grade, so that this advantage, which is essential for the mass use of such a type of construction, is lost.

Engine on Hot Air—Ericsson(1833.)

The engine consists of the expansion and compression cylinder with the pistons that are also arranged in the mutual angular phase shift. The used fluid is the air, which, cooled to the initial stage, circulates in the (closed) system from the compression cylinder via the heated heat regenerator towards the fire place, accepting the heat to the expansion cylinder and achieving the expansion work, and then getting out of the expansion cylinder and giving away the remaining heat to the regenerator and cooler again to the initial input state. The difference between the expansion of the hot air and the compression of the cooled air is the useful work. Also at this constructional variant, the discontinuity between the expansion and the compression is visible, mainly due to the angular phase shift, where the state changes of the working fluid last shorter than the heat conducting-to or -away, and therefore the additional characteristic assemblies, such as the heat regenerator and cooler, are necessary for the cycle improvement.

Engine on Hot Air—James Joule(1851.)

The engine on hot air is almost identical to the Ericsson one (1833.) but without the heat regenerator, so that, if ever it had been made in practice, it would have a worse thermodynamic efficiency grade. On the other hand, it is of a simpler construction and therefore, more or less, the described problems still remain.

Marine Engine on Hot Air—John Ericsson(1853.)

Ericsson has succeeded to improve and introduce in practice the marine engine on hot air. The compression cylinder has sucked-in the cold atmospheric air to the pressure container, which would be preheated via the heat regenerator and introduced into the expansion cylinder that is additionally heated by an external heat source. By transferring the expansion work, the hot air would cool down in the same improved heat regenerator made of a compact the wire net, what has been the main novelty of the embodied construction. Also, at this constructional variant remain the same problems of the cycle discontinuity, the phase shift, the use of additional characteristic assemblies, the air battery and the heat regenerator of a more sophisticated realisation.

Engine on Hot Air—Ericsson(1860.)

This engine on hot air is made on the basis of the Stirling principle, where the air is not in the closed system but is sucked-in cold, heated and after the expansion, still hot, expelled without the heat regenerator into the atmosphere. Therefore, the efficiency grade is extremely bad, but the construction is simple, practical and reliable, what was an insufficient reason for the mass use.

Engine on Hot Air—Lamberau(1861.)

It is also made on the basis of the Stirling principle with the air in the closed system, which is heated at one side and cooled at the other side. The improvement consists in, that the hot and cold cylinder ends are recessed, and in such a way the heating and cooling is enabled at the inner and outer side of the cylinder. Beside that, the surface of the distribution piston is increased by means of the thin tin sheet cylinder, according to the example made by Ericsson (1860.). Due to the resistance increase of the air circulation around the tin sheets, the engine has achieved a lower power than expected. All essential drawbacks, indicated before, remained further on.

Engine on Hot Air—Lehmann(1866.)

This engine had also two pistons in one cylinder, the longer distribution piston and the shorter working piston, as the described improved variant of the Stirling engine (1816.). The difference is only in the driving mechanism and the engine position, what are not some essential constructional improvements.

Gloy—Stirling Engine with Swinging Piston (1877.)

This engine is interesting by the idea, because the piston, instead of the vertical motion, performs the swinging, transferring the air only from the hot into the cooled space of the cylinder. Also, at this construction the essential problems of the cycle discontinuity are not solved.

At the thermal hydro machine on hot air with recirculation according to this patent application, the in the assembly completely independent partial cylinders with collectors, in which there is the independent partial working fluid, perform the rotational relative motion opposite to the rotation of the working wheel, being conducted without swinging firstly across the heat source and then over the cooled space. But, the essential difference is in the fact, that the free pistons of the independent cylinders still move forward-backward (or alternately upward-downward) along the axes of the parallel cylinders, which is parallel with the main shaft of the engine, achieving in such a way a linear-reversible motion.

Engine on Hot Air—John Ericsson (1880.)

The engine is also of the Stirling type with two pistons in one cylinder. In such a way the number of the characteristic assemblies is reduced, what meant on one side the simplification of the constraint, but on the other side the realisation of the driving mechanism became complicated, because the piston rod of the distribution piston passed through the mobile working piston. Also here, the discontinuity of the conversion process and the angular phase shift are the main drawbacks of the construction in relation to the proposed model in the patent application.

Engine on Hot Water—John Malone(1931.)

Although the engine worked on hot water instead of hot air, it was based on the Stirling type construction with the known essential constructional drawbacks, which have already been mentioned. Due to a much lower expansion coefficient of the liquid than of the air, this construction had to be additionally reinforced and adjusted to high pressure. Beside that, for a small move of the working piston in the working cylinder a plurality of long tubular distribution cylinders with distribution pistons is necessary. The advantage is a better heat transfer onto the liquid than onto the steam phase, and therefore the engine has a better thermal efficiency grade.

The registered variant of the type constructional realisation of the thermal hydro- machine on hot compressible fluid (gas) with recirculation can easily be adjusted also for the hot incompressible fluid (liquid). Effectively, it has in itself already the secondary incompressible recirculation medium as the work transmitter, which can partially or entirely replace the air or the steam phase and become in such a way the primary work transmitter, as Malone has proposed it. As the registered construction otherwise has not a separated distribution and working cylinder, with pistons rigidly connected with a phase shift, they become a characteristic assembly, what means a simplification of the construction. Just the Malone tubular cylindrical exchangers with the distribution pistons, as a good alternative, are suitable for reassignment into the segment working tubular cylindrical exchangers with the working pistons in the registered construction. For the case of the entire or partial replacement of the compressible fluid (the air) with a much less compressible or conditionally incompressible fluid (the liquid) in one of the alternatives, the working pistons would not be necessary at all. But then, in the ultimate case, the compensation problem of the high pressures due to the expansion of the liquid in the rigid closed system appears, which can only be accomplished by the compressible compensator. Therefore, one again returns to the idea of the variant of the compressible working fluid in combination with the recirculation incompressible medium as the power transmitter, although the heat transfer onto the air is worse.

Philips Mechanism—Stirling Engine (1947.)

In this somewhat more improved constructional variant than the present constructions, both pistons, the distribution and the working piston, are placed in the same cylinder. In order to maintain the rigid connection between the pistons and the working shaft as well as the angular phase shift between the pistons, it was necessary to make a, at that time, technologically complicated, manifold bent crank shaft. Although it is not a problem to manufacture a crank shaft by the present technology, because already in 1954 the company Philips has successfully applied it on a left-turning cooling machine, the same one is avoided. So, in 1958 the Meijer rhomb drive was applied as a simpler and more acceptable solution of the calm, uniform drive of the Stirling engine. But, also the rhomb drive is actually a rigid phase connection between the pistons with similar effects on the thermal cycle. Although by that construction certain improvements have appeared, the main drawbacks remained, such as the discontinuity of the process of the heat energy conversion into the mechanical work. At that, particularly the expansion or the compression do not last as long as the heat conducting-to and conducting-away respectively, or they last a shorter time, periodically exchanging isothermally incompletely in accordance with the rigid driving mechanism at the phase shift that connects them. Therefore, the distributing piston, although it is rationally placed in the same cylinder as also the working piston, has except the assignment of distributing the working fluid also the assignment of the heat battery which actually reduces the efficiency grade of the thermal machine.

By the registered type construction of the thermal hydromachine on hot gas with recirculation these drawbacks are eliminated, and the cycle gets a more improved isothermal continuity without the heat battery (the distribution piston) and the rigid phase driving connection (the crank shaft or the rhomb mechanism), which is replaced by the secondary recirculation incompressible medium as the process catalyst.

Modern Engine of Stirling Type—Meijer(1958.)

As already indicated, instead of the crank shaft (Philips 1947), Meijer (1958.) has applied a simpler rhomb mechanism that ascertained a calm and uniform work of the engine. Beside that, in accordance with the earlier designers, who have also proposed the increase of the cylinder heating surface, he has introduced the original tubular exchanger for a more intensive heating of one cylinder part, and he has also by means of the block of tubular exchangers improved the cooling of the cylinder other part. He introduced the regenerator between the hot and cooled part of the tubular exchanger's assemblies. An additional improvement is also the preheating of the air for the combustion, what has resulted with an enviously high efficiency grade. Even at this construction, the two pistons in one cylinder remain. Except for the heat regeneration by means of the distribution piston, this effect is also improved by the regenerator between the tubular exchanger's assemblies, which represents an additional characteristic assembly that should be, if possible, avoided. Although the tubular exchanger's assemblies for heating and cooling are much more efficient at the heat transfer than the direct cylinder heating or cooling, the expansion and compression discontinuity remained, so that in such a way better effects can be accomplished only to a certain limit. Certainly, that to this also the rigid connection between the pistons contributes, by which the state changes are dictated.

The registered construction of the thermal hydro-machine with recirculation contains the rotational heat exchanger with a series of independent segmented tubular collectors, which are firstly conducted over the heat source, then over the cooled space, so that they serve in the same time also for cooling the working fluid. Also, the rigid connection between the pistons is eliminated, which are not in a significant phase shift any more, so that the state changes are in a satisfactory isothermal continuity lasting simultaneously during the entire time period of the heat conducting-to and -away. Instead of the rigid mechanical connection in the phase shift, the recirculation incompressible medium as the secondary work transmitter or as a hydrodynamic adjustable connection between the working pistons as well as the process catalyst between the hot and cooled part of the machine are introduced. Just due to that, the heat regenerator, as an additional characteristic assembly that firstly accepts and then with losses gives away the heat, is not necessary. Instead, the recirculation medium takes over this assignment in the form of the stationary hydrodynamic flow that has substantially less losses.

Artificial Heart on Nuclear Propulsion—Martini(1967.)

The artificial heart is a thermal machine on hot gas according to the Papin principle. Instead of the classical drive the nuclear capsule is used, and the cooling is performed by the blood circulation, controlled by the membrane circulation pump. Also, this small special thermal machine, assigned for maintaining the life of living creatures, has in its embodiment the heat regenerator made of the compact wire net, as an additional characteristic assembly.

The often pointed out discontinuity between the heat conducting-to or -away in relation to the duration of the gas state change, either the expansion or the compression, is an inevitable factious reality at this constructional embodiment too.

Engine on Hot Water—Ivo Kolin(1982)

By the original constructional embodiment, the path of a series of low-temperature flat thermal machines based on the Stirling principle is marked. In them, the chamber on hot air and with the working membrane replaces the working cylinder. Inside the chamber, instead of the distribution piston, there is a thermally insulated plate, which by swinging in a certain position, when leaning against the hot side of the exchanger, prevents the heat conducting-to and the air heating, and enables the air cooling via the mobile exchanger with the membrane on the cold side of the chamber. In the other position, when the plate is moved away from the hot side, but leans against the cooled side of the chamber along the working membrane that takes over the assignment of the piston, the intensive heating of the working gas is enabled. The heat source can be a various continuing low-temperature heat of the heated water, air or the sun radiation, and the heat transfer onto the working fluid is conditioned by the periodical position of the insulated plate, what gives to the process a discontinuity characteristic. The obtained work is transmitted by means of a rigid lever mechanism onto the machine shaft, and the useful work is given by the difference between the expansion and compression work, as it is the case with all thermal machines working on the same principle.

It is important to see, that also at this construction there is no intensive simultaneous heat conducting-to to the working gas, although the heat source is active and heats the working plate, which takes over the assignment of the heat battery as long as the compression lasts, or there is no intensive cooling of the working medium during the expansion although the working plate is cooled (the regenerator), so that in the same time they do not help each other completely, what gives a discontinuity character to the process. This happens, because the entire same working gas alternately takes part one instant in the expansion, the next instant in the compression. The state changes are carried out in the time phase shift as at the other thermal machines, where the rigid driving connection exists. Due to the fact, that the entire conducted-to heat from the primary, permanently active and never drying-up source is not immediately and completely transferred continually onto the working fluid that accomplishes the work by expansion, the heat battery is necessary. In this case, this will be the exchanger's plate, which will accept a part of the conducted-to heat from the primary source and store it during the expansion interruption time. It is certain, that in reality also this process will be followed by a lower efficiency of the thermal machine, what is also the characteristic of this constructional realisation that contains the heat accumulation, even if this ought to be the working plate. In such a way, on account of a limited efficiency increase by introducing the regeneration and heat accumulation, the construction becomes additionally more expensive.

Therefore, the best way is to transfer the conducted-to heat without delay and accumulation directly to the working gas during the expansion, and in the same time, by cooling the working gas, to conduct the heat away directly, without delay and regeneration, during the compression. The perfection of the thermal machine construction is, when the expansion and compression are not phase shifted and last simultaneously during the entire time period of the primary heat conducting-to or entire time period of the primary heat conducting-to or -away. This is not possible to achieve for the same working fluid that is separated or moved from (one part of) the immovable cylinder into the other (part of the) cylinder, so that by this patent it is tried to provide state changes of the independent working gas in independent mobile cylinders, wherever this is possible. Only under such a condition it is possible in practice to achieve an approximately isothermal state change, which will approach the anticipated ideal cycle. The just registered type construction of the thermal hydro-machine with recirculation enables this, because it fulfils in a great deal the requirements indicated as a problem, and in such a way solves in a best way the general technical problem of the thermal energy conversion into the mechanical work.

Essence and Technical Novelty of the Invention

The technical novelty of the invention is the new type construction of the thermal machine adapted to a corresponding new ideal, right-turning, thermodynamic cycle. The new ideal thermodynamic cycle, except that it contains the essential isothermal state changes of the expansion and compression that are characteristically for the majority of equivalent ideal working cycles at the heat conversion into the mechanical work, contains also the combination of the mixed isobar and isochors state changes. The new, simplified thermodynamic cycle presented in the p-v and T-s diagrams (FIGS. 1 and 2), which is imitated by the type construction, contains the following state changes of the working gas:

- the isobaric expansion (2-3) at the heat conducting-to in the hot space
- the isotherm expansion (3-4) at the heat conducting-away in the cooled space
- the isochors (4-1) at the heat conducting-away in the cooled space
- the isothermal compression (1-2) at the heat conducting-away in the cooled space By entering the segment cylinder with the belonging collector into the hot space, to the working gas the heat is isobarically conducted-to (2-3). At that, one part of the heat is used for increasing the internal energy of the gas to temperature $T_3$, and one part for accomplishing the work at the isobaric expansion (2-3) for actuating the piston and pressing the recirculation medium. When the heat conducting-to is made equal with accomplishing the piston work without the increase of the internal energy of the working gas, the isothermal expansion (3-4) starts. When the segment cylinder with the belonging collector leaves the range of the hot space (the heat source) and enters the cooled space, due to the heat conducting-away the internal gas energy is decreasing at the isochors (4-1) to temperature $T_1$ without accomplishing the piston work. In the moment when the heat conducting-away from the working gas is made equal with the work of the compression, thus without a further decrease of the internal energy, the isothermal compression (1-2) starts, at which the working piston due to the action of the recirculation medium takes the initial position.

By that, the simpler form of the ideal working cycle, at the full relative turn of the segment cylinder with the belonging collector about the main shaft, is completely terminated at passing through the range of the hot and cooled space. In such a way, each next segment cylinder with the collector makes a separate cycle with a small mutual time phase shift, just as much as it is necessary to pass the interlocking angle of the peripheral path between two adjacent segments. At that, a major number, or approximately something less than the half in the hot space, achieves a set of independent expansions, and, in the same time, the remaining number, or approximately something less than the half in the cooled space, achieves a set of independent compressions in a different stage of the described cycle.

Power of the Thermal Hydro-machine P $$P = k \cdot \Delta T^3 = \frac{\sum_{i=1}^{n} V_i \cdot \Delta T^3}{2 \cdot 10^8} = \frac{V \cdot \Delta T^3}{2 \cdot 10^8} \text{ [kW]}$$

ΔT-temperature difference of the hot and cooled part of the hydro-machine [°K]

$V_i$-working volume of the segment cylinder [1]

V-total working volume of the hydro-machine or of all segment cylinders $$V = \sum_{i=1}^{n} V_i \qquad [1]$$

The total working volume of the thermal hydro-machine, on which directly depends the power, is equal to the sum of all partial working volumes of the segment cylinders, in which the independent working cycle is achieved.

Thermodynamic analysis (according to FIGS. 1 and 2)

Unit Conducted—to Heat $q_d$ $$q_d = c_p \cdot \Delta T + \Delta S_{34} \cdot T_{\max} = c_p \cdot \Delta T + R \cdot \ln\frac{p_3}{p_4} T_{\max} [\text{J/kg}]$$

$$p_3 = p_{\max};\ p_4 \rightarrow p_1 = p_{\min}$$

For a substantially slow cycle the predominantly isothermal state changes at shorter not-isothermal state changes are achieved, so that the cycle gets the form of an isothermal continuity.

$$q_d = c_p \cdot \Delta T + R \cdot \ln\frac{p_{\max}}{p_{\min}} \cdot T_{\max} [\text{J/kg}]$$

Unit Conducted—away Heat $q_0$ $$q_0 = c_v \cdot \Delta T + \Delta s_{12} \cdot T_{\min} = c_v \cdot \Delta T + R \cdot \ln\frac{p_2}{p_1} \cdot T_{\min} [\text{J/kg}]$$

$$p_2 = p_{\max};\ p_1 = p_{\min}$$

$$q_0 = c_v \cdot \Delta T + R \cdot \ln\frac{p_{\max}}{p_{\min}} \cdot T_{\min} [\text{J/kg}]$$

Unit Useful Work $j_e$ $$j_e = q_d - q_0 = (c_p \cdot \Delta T + \Delta S_{34} \cdot T_{max}) - (c_v \cdot \Delta T + \Delta S_{12} \cdot T_{min})\ [\text{J/k}]$$

For the indicated approximation of the isothermal continuity $$j_e = \Delta T \cdot (R + \Delta s) = \Delta T \cdot R \cdot \left(1 + \ln\frac{p_{\max}}{p_{\min}}\right) [\text{J/kg}]$$

$$\Delta s_{34} \approx \Delta s_{12}$$

The total useful work of the thermal hydro-machine, which is transferred via the pistons onto the recirculation medium, the working wheel and shaft, is equal to the sum of the partial works achieved in the independent working cycles of all segment cylinders.

The total useful work is approximately equal to the difference of all partial works of the expansion of the independent hot working gas and of the compression of the independent cooled working gas, what is actually almost the difference between the conducted-to and -away heat to the rotational heat exchanger.

Thermodynamic Efficiency Grade $\eta_t$ $$\eta_t = 1 - \frac{q_0}{q_d} = 1 - \frac{R \cdot \ln\frac{p_{\max}}{p_{\min}} \cdot T_{\min} + c_v \cdot \Delta T}{R \cdot \ln\frac{p_{\max}}{p_4} \cdot T_{\max} + c_p \cdot \Delta T}$$

$$p_4 \rightarrow p_1 = p_{\min}$$

Total Efficiency Grade $\eta_u$ $$\eta_u = \eta_t \cdot \eta_h$$

$\eta_h$—Hydraulic Efficiency Grade

On the base of the ideal working thermodynamic cycle, which is carried out between the indicated state changes presented in the p-v and T-s diagram (FIGS. 1 and 2), for the offered type solution of the thermal hydro-machine the real working cycle in the independent segment cylinder can be simulated by the approximate dotted curve "a" and "b".

By this type constructional realisation of the thermal hydro-machine with recirculation, what is a novelty in the development of thermal machines, the partial expansions of the working gas happen almost simultaneously during the entire time period of the heat conducting-to, and the partial compressions of the working gas happen almost simultaneously during the entire time period of the heat conducting-away. This is the essence of the qualitative process improvement, where the independent partial expansions, which happen simultaneously parallel with the compression, help each other via the recirculation medium, achieving the continued heat conversion into the mechanical work. In them, the simultaneous non-isothermal state changes at the heat conducting-to and -away last less than the isotherms, at which the greatest part of the heat in a simple way immediately self-regenerates in a non-thermal form without the additional characteristic assemblies and greater losses.

By this invention the main drawback of the discontinuity is eliminated, because the entire working gas in the belonging segment cylinders is simultaneously heated or alternatively cooled, what depends on the position at the relative motion either in the hot or in the cooled space. By that, the expansion duration in the mobile cylinders is almost completely levelled and adjusted with the heat conducting-to, and in the same time the compression duration is almost completely levelled and adjusted with the heat conducting-away.

Due to the fact that the working cylinders together with the working gas exchange the positions in the hot and cooled space, it is possible by the variation of the relative motion to adjust the speed of the state changes as necessary, in a way that the expansion and compression are theoretically approached to the most convenient isothermal state change. In such a way, the conversion of the thermal energy into the mechanical work happens in a simplest natural way by the intensity that is given from the heat source at the greatest efficiency. The new type constructional solution consists in the application of the mobile rotational heat exchanger, which is practically composed of a set of independent segment partial collectors that terminate with the working partial cylinders and the belonging free pistons. The rotational heat exchanger accomplishes the transient rotational relative motion about the main shaft with respect to the stationary heat source or to the alternatively cooled space. In such a way, an adequate selective state change of the compressible fluid (the gas) is simultaneously achieved in several independent partial working cylinders of one machine part in the hot space, and, simultaneously, another adequate one is achieved in the other machine part in the cooled space. Actually, with a sufficient number of independent, segment cylinders that enable a slow process, an optimal harmonisation of the selective state changes is achieved, which become predominantly isothermal, imitating the mentioned theoretical cycle.

One closed working cycle in the independent segment cylinder lasts as long as one full turn of the relative motion about the main shaft, what is of decisive importance for the work efficiency of the thermal hydro-machine. Due to the fact that the state changes of the working gas happen independently, simultaneously and harmonized, the greatest part of the conducted-to heat is directly converted into the expansion work, and the greatest part of the conducted-away heat directly reduces the consumption of the compression work, transferring it via the pistons onto the incompressible recirculation medium in the form of the hydrodynamic flow. Simultaneously, the greatest part of the heat is self-regenerating at the shorter not-isothermal state changes into a not-thermal form of the hydrodynamic recirculation. The compression work in the theoretical sense can have even an opposite sign, if at the begin of the compression the under pressure of the working fluid is achieved, as this was the case with the miner's pump. The total useful work would then be exceptionally convenient, because the expansion would actually be supported by the compression work, so that this type construction gives unbelievable possibilities in the development and improvement of thermal machines. At accomplishing the under pressure, the known, harmful cavitation effect could be excepted at the flow of the recirculation medium, which by all means should be avoided by the choice of a vortex-less stationary flow, so that the work with the under pressure could open new difficulties.

By this invention the number of characteristic assemblies taking part in the thermal process is deduced only to two, what is today substantially the least possible number, so that the type construction becomes the simplest constructional solution.

The first one is relatively turnable characteristic assembly I, which consists of the cylindrical heat exchanger composed of a set of independent segment collectors, which are continued on paired cylinders with pistons, as well as of directed, returnable and exception channels. There is no extra hot or extra cold exchanger, because they are completely equal, but their substituting working function is determined by the position with respect to the heat source or the cooled space. There is no classical working gas distributor, but the self-driven mechanical (variable) transmitter of assembly III takes over this role of the relative turning between two characteristically assemblies, the relatively turnable assembly I and working turnable assembly II. There is no battery or, according to the function, the heat regenerator, although the exchanger's assembly reminds on them, because the heat of the source converts without delay directly into the hydrodynamic flow and the driving of the working wheel. However, a part of the hydrodynamic energy of the vortex less useless flow is actually an accumulation of the already converted heat energy, so that therefore the classical regenerators or heat batteries are not necessary, where the heat without significant losses with a small delay terminates over the working wheel as a useful mechanical work on the shaft of the hydro-machine.

The second working turnable characteristic assembly II is the classical turbine working wheel with curved vane channels for the conversion of the hydrodynamic energy of the flow into the mechanical work according to the today known principle. The mechanical (variable) transmitter replaces the role of the classical working gas distributor, by means of which the relative motion of the working gas independent contents is achieved and the same one is introduced in a certain cycle phase. It is the integral part of the construction of the thermal machine by which two characteristic assemblies are mechanically coupled, but actually it is not a characteristic assembly and has the role of the cooperating member. It is important, because by means of it the cycle speed is directly changed, and by that it influences indirectly the quality of the thermodynamic conversion process.

The novelty is the introduction of the recirculation incompressible medium between the expansion and the compression as an adjustable hydrodynamic work transmitter and conversion catalyst of the thermal machine total work, which replaces the rigid connection. By introducing the recirculation medium between the pistons of the segment cylinders of the hot and cooled block of the thermal machine, the continued hydrodynamic connection between a series of simultaneous expansions and compressions is accomplished, where the consumption of the compression work is deduced to the least measure. Such recirculation medium accepts the entire expansion work of the working gas that takes part in a particular phase of the process, and delivers it to the working wheel. On the other side, the consummation of the compression work is reduced, because the compression pressure is reduced to the level that simultaneously urges the hydrodynamic energy of the flow. In order to achieve the flow continuity of the recirculation medium without losses due to vorticity (df=0), the conditionally useless circulating flow by the return directed channels, back to the working wheel is necessary. The useless flow ensures the continuity of the hydrodynamic flow and partly also the accumulation of the not thermal energy in the hydro-machine vorticity. Otherwise, if the flow would be turbulent, the efficiency of the conversion would be significantly decreased, and by that also the useful work. The useless flow is actually the consequence of the ejector action of the main flow at the entrance into the working wheel and of the low-pressure suction effect of the compression cylinders at the exit from the working wheel. By introducing the recirculation medium, the hydrodynamic energy of the flow, at the dual role of the exchanger's assembly, completely replaces the thermal accumulation and the heat regeneration, eliminating the discontinuity of the conversion process, so that the additional characteristic assemblies, such as heat batteries and regenerator, are not necessary. Beside the fact that the recirculation incompressible medium is a continued work transmitter with the introduction of the additional characteristic assemblies, the novelty is that it has the role of the catalyst of the entire conversion process, because it compensates in the best possible way the intensity unevenness of the variable thermodynamic parameters of the partial state changes. In such a way, the heat converts into the hydrodynamic energy of the flow by such intensity as it arrives with the greatest temperature difference of the working gas in the working cycle, which approaches to the temperature difference of the heat source and the cooled space.

By this constructional realisation, the expansion duration and intensity in each cylinder can be optimized to such a measure, that the working fluid almost reaches the temperatures of the heated space and delivers the work all the time during the passage through the hot space. The entire obtained expansion work is actually the sum of all partial works in the independent, segment cylinders in the hot space. Also, the analogue duration or speed of the compression state change can be optimized to such a measure, that the working fluid almost reaches the environmental temperature.

DESCRIPTION OF DRAWINGS

Figure 3:
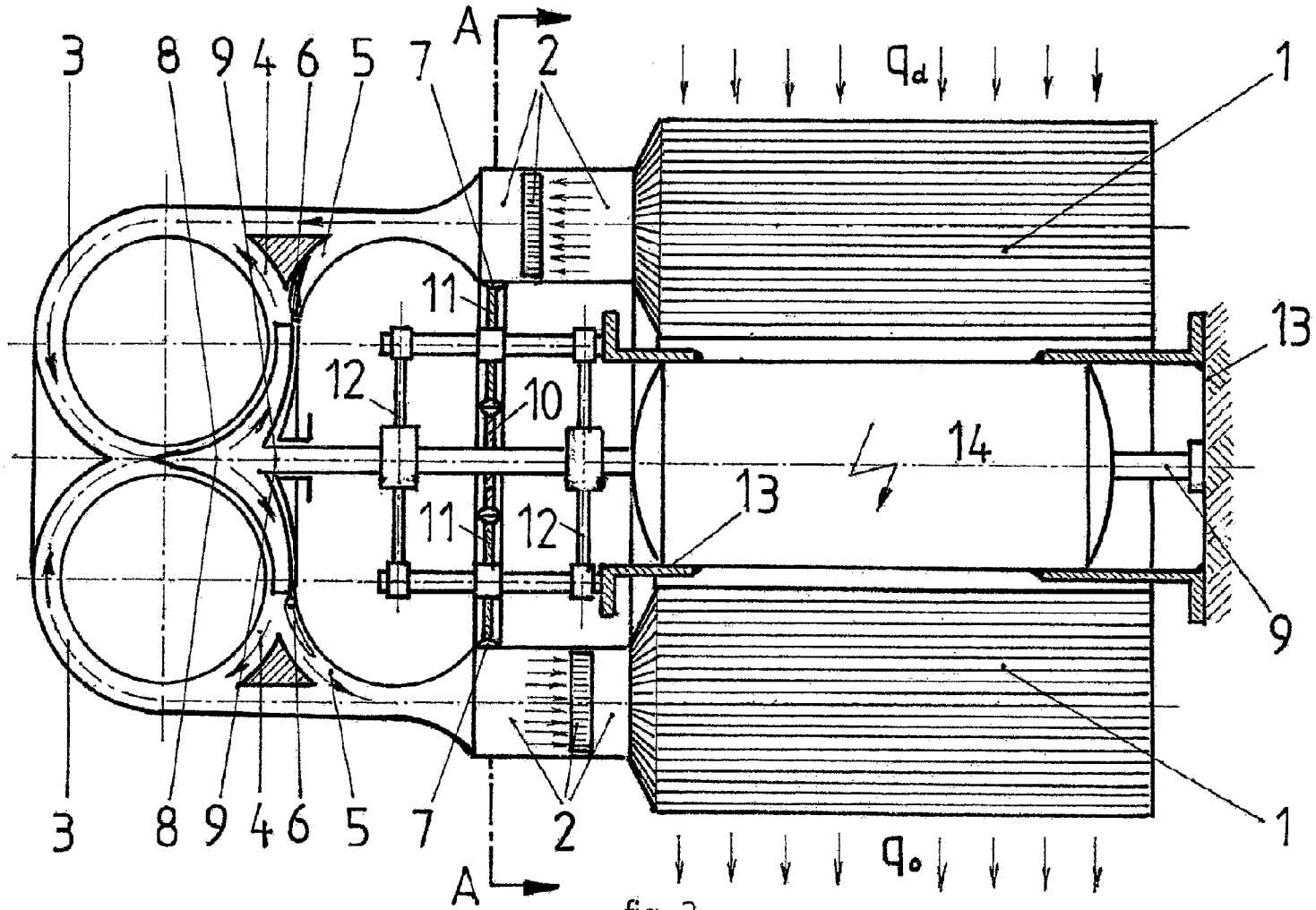
FIGS. 3-5 disclose the construction of the thermal hydro-machine on hot gas with recirculation.
Figure 4:
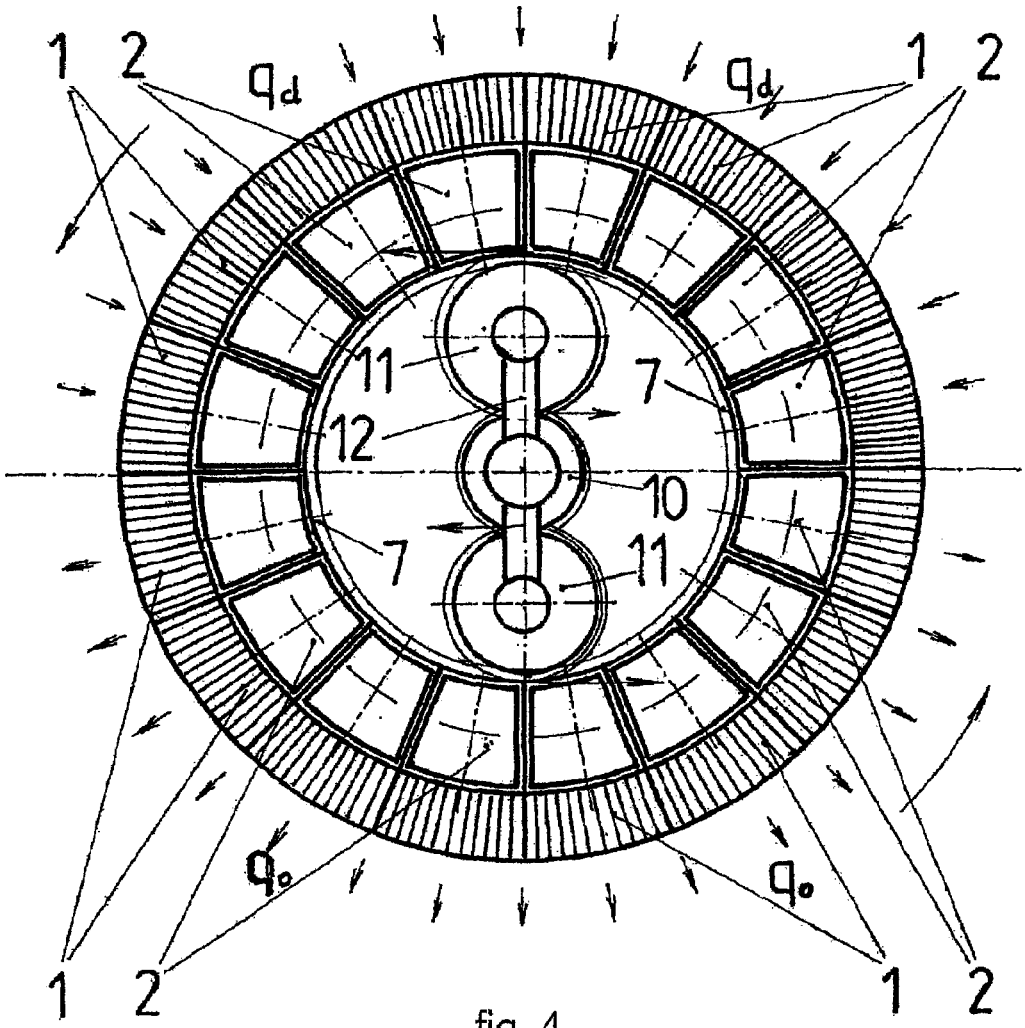
Figure 5:
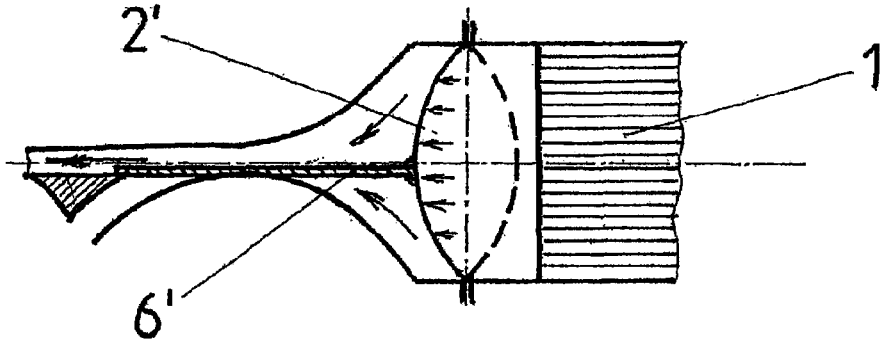

The construction of the thermal hydro-machine on hot gas with recirculation (FIGS. 3, 4 and 5) consists of:

Assembly I—Relatively turnable characteristic assembly;

- Rotational heat exchanger composed of a set of segment collectors (1),
- Working segment cylinders with free pistons (2), or alternatively
- Working segment chambers with elastic membrane (2'),
- Directing channels (3),
- Return channels for recirculation (4),
- Return channels for excepting the recirculation medium (5), Mobile vanes (6) or alternatively
Axially mobile closers (6'),
Teething (7),
Assembly II—Working mobile characteristic assembly;
Working vane wheel-turbine (8),
Working shaft (9),
Driving transmitter of the relative motion (10),
Assembly III—Mechanical intermediate transmitter;
Driven pair of intermediate transmitters (11),
Embracing carrier (12),
Casing or stand (13),
Generator (14)

Description of the Elements of Assembly I:

(1) The rotational heat exchanger is composed of a set of independent segment tubular collectors that are arranged in one whole in the form of the cylindrical shell. Each such segment collector is a separate smaller, partial heat exchanger, which can have a dual role of the heat receiver or deliverer, depending on the relative position with respect of the heat source or the cooled space. The segment collectors, filled-up with the compressible fluid (gas), are adapted to the heat source, in the rule with a great (or great as possible) possibility of accepting or delivering the heat in unit time. In the most common case, this is the tubular exchanger, which size, shape and geometry in the space are adapted to the kind and intensity of the heat source.

(2) The working segment cylinders with the free pistons are continued on the segment collectors. In them are prolonged the partial state changes of the working compressible medium (gas) started in the segment collectors, transferring the work via the pistons in the cylinders onto the recirculation incompressible medium at the other side of the pistons, pressing it by the directing concentration channels towards the working turbine vane wheel. The free pistons prevent the mixing of the working compressible fluid (gas) and the recirculation incompressible one, accomplishing the hydrodynamic connection between a set of partial state changes. The working cylinders can be thermally insulated, since the heat exchange is carried out exclusively via the heat exchanger.

(2'). The working chambers with the elastic membrane are the alternative instead of the working segment cylinders with the same functional role.

(3) The directing channels make an assembly of semi-circular, curved, concentrating channels, which direct the recirculation medium from the periphery of the cylinder in the hot part towards the axis of the working vane wheel, converting the pressing expansion work into a growing hydrodynamic flow energy. The directing of the recirculation medium is carried out identically also in the cooled part of the hydro-machine, as a working and useless flow necessary to maintain the flow continuity. The directing channels are also a part of the whole of relatively turnable assembly I, which is in a slower relative motion opposite to the rotation sense of working, turnable assembly II.

(4) The return channels for the recirculation are made of a set of widening, curved channels on the exit from the vane working wheel, necessary for the need of the hydrodynamic flow recirculation, via which the flow continuity towards the working wheel again is accomplished. They are connected with the directing channels on the periphery, accomplishing a continuous flow without vorticity.

(5) The return channels for exertion are made of an assembly of widening, curved channels on the exit from the vane working wheel for the need of exerting the recirculation medium and of the compression filling of the liberated space in the cylinders of the cooled part of the hydro-machine. In order that the exertion would be carried out disturb less only in the cooled part of the hydro-machine by the arch wise mobile vanes, the channels are opened due to the under pressure, while in the same time in the hot part, by the fore pressure on the vanes, the exertion channels are kept closed.

(6) The mobile vanes for closing and opening the return, curved exertion channels are placed on the periphery of the entrance into the return exertion channels, changing the position open-closed individually and arch wise, conditioned by the under-pressure or pre-pressure of the recirculation medium, according to the requirements of the process. They enable the flow in the cooled part or prevent the flow in the hot part of the hydro-machine, also without the vorticity of the recirculation medium.

(6') The axially mobile closers for the alternative closing and opening of the return curved exertion channels instead of the mobile vanes, placed along the periphery of the exit from the return exertion channels, and rigidly connected onto the free pistons (or alternatively the elastic membranes) with the same working function.

(7) The teething is built-in onto the casing of assembly I, and it serves for accomplishing the driving coupling with assembly II for the drive of the relative motion of assembly I at conducting the rotational heat exchanger over the hot and cooled space.

Description of the Elements of Assembly II:

(8) The working vane wheel (the turbine) is a classical element of the hydro-machine, where the hydro energy of the flow is converted into the mechanical work and is transmitted onto the working shaft. It consists of a set of curved vane channels in the form of a turbine, according to the technical solutions known at present. It is certain that the construction of the vane wheel should be adapted according to the specific conditions of the vortex-less flow at minimum hydraulic losses. The rotation sense of the vane wheel determines the curvature position of the vanes, and it is opposite to the relative motion of assembly I. The working vane wheel is rigidly attached onto the working shaft of the hydro-machine.

(9) The working shaft transmits the useful mechanical work from the working wheel to the user. It is freely embedded with respect to the casing of the consumer, which is connected with the stand against which leans the entire construction of the hydro-machine. The driving transmitter of the relative motion is rigidly attached onto the working shaft.

(10) The driving transmitter of the relative motion is a part of the classical mechanical transmitter of an adequate transmission ratio, by which the slower relative motion of relatively mobile characteristic assembly I with respect to working turnable characteristic assembly II is enabled, the relative motion is necessary in order that the exchanger segment unit could be alternately conducted over the heat source or the cooled space, repeating the cycle.

Description of the Elements of Assembly III:

(11) The driven pair of intermediate transmitters, which freely rotate in the embedment of its eccentrically and parallel set shaft with respect to the main shaft, and which is also via the embedded carrier connected onto the working shaft and rigidly fixed onto the stand or the casing of the machine. This can be an ordinary cylindrical gear wheel, which is coupled with the cylindrical gear teething on assembly I and with the driving gear wheel of assembly II.

(12) The embracing carrier with the casing is a rigid embedded lever on the working and eccentric shaft, which keeps the driven intermediate transmitter on an eccentric distance and is connected with the casing or the stand.

(13) The casing of the machine is firmly connected onto the immovable stand, what is the main support for the drive of the working and relative motion. The casing can serve as an immovable element for fixing the stator at the electric energy production.

(14) The generator serves for the alternative conversion of the rotational mechanical energy from the shaft of the hydro-machine into the electric energy for the universal use.

The way of the Invention Realisation

Figure 1:
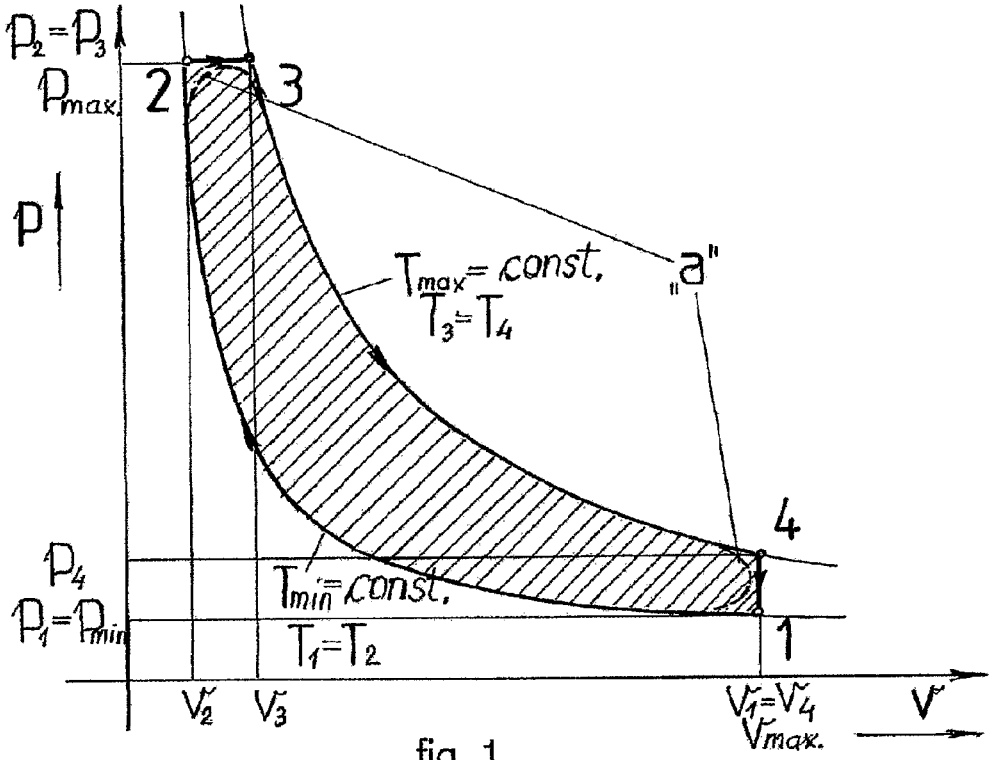
FIGS. 1 and 2 show the p-v and T-s diagrams for the working cycle.
Figure 2:
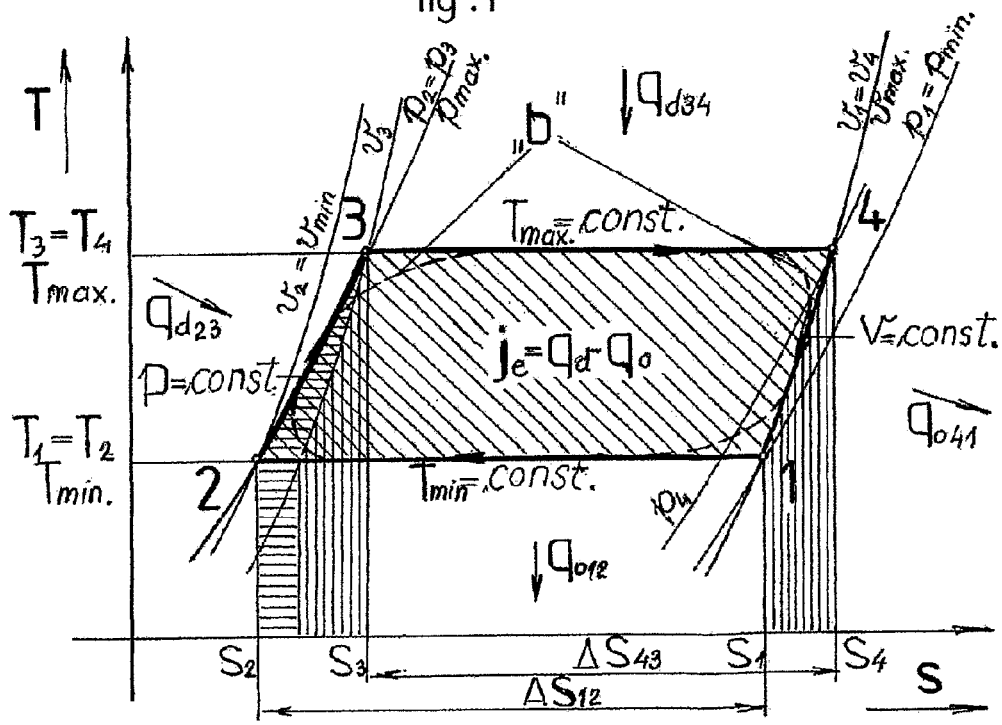

The type construction of the thermal hydro-machine on hot gas with recirculation (FIGS. 3, 4, and 5) for the solution of the technical problem of the thermal energy conversion into the useful mechanical work consists in the application of the mobile rotational tubular heat exchanger that is composed of a set of entirely same independent segment collectors (1) arranged in the form of the cylinder shell. Each segment collector (1) terminates with paired independent segment cylinder (2) or, alternatively, with segment working chamber (2') inside of which there is the working gas in a closed system. In the cylinders the axially mobile working pistons are freely placed or, alternatively, elastic membranes (2') are placed in the working chambers. The heat conducting-to is foreseen at the outer side of one part of the rotational heat exchanger, in the same time on several segment collectors (1) that pass over the heat source. The heat conducting-away happens in the same time, also at the outer side of the other part of the heat exchanger of the remaining part of segment collectors (1). So, simultaneously in the hot space a set of independent expansions is carried out in each of adjacent segment cylinders (2) or, alternatively, , in the working segment chambers that are still mutually in a small time phase shift. In an analogue way, in the cooled space a set of independent adjacent compressions of the working gas is simultaneously carried out, where the state of the gas is determined by the position, and they are also mutually in a small phase shift. The partial expansions and compressions of the entire contents of the independent working gas of each segment cylinder (2) are continuously exchanged at the passage through the hot or cooled space, accomplishing at the full relative turn the indicated working cycle presented in the p-v and T-s diagrams (FIGS. 1 and 2).

By this type constructional realisation it is possible to chose the optimum speed of the thermodynamic conversion process, where in reality the key state changes will approach the thermodynamically most convenient isothermal cycle, and at the shorter not-isothermal state changes it regenerates the heat in the best way. This is today the tendency of all modern constructions of thermal machines. Also, the proposed construction variant enables the choice of the most convenient collector size, shape and geometry, adjusted according to the specific requirements of the kind of the heat sources or cooled space. Actually, these requirements fortunately match completely, so that the same exchanger as a substitute accomplishes well both functions. Particularly convenient and efficient for the heat accepting or delivering is the simple tubular exchanger, which a long time ago has been proposed by Meyer (1958) and still works today, so that it is also proposed for this type construction. By this type of construction it exists the possibility of choosing the most convenient volumetric relationship between the entire hot and entire cooled volume of the working gas. It is possible to achieve the changed volumetric relationship by a slight decrease of the interlocking angle of the heat source towards the collector's exchanger or analogous, by the increase of the interlocking angle of the under cooled space. A too great change of the relationship of the working volume in the hot and cooled space is not recommended, because it would disorder the hydrodynamic flow without vorticity, so that this will be the matter of optimisation and improvement of the thermal hydro-machine. It is also possible to choose the optimum compression ratio of the working gas in the independent segment cylinder with the belonging collector.

The expansion work of the working compressible fluid of the working cylinders in the hot space is transmitted onto the free working pistons in the cylinders (alternatively, the elastic membranes), which are pressed in the form of a working active hydrodynamic flow by the recirculation incompressible medium through the directing semi-circular curved concentric channels (3) from the periphery towards the centre of vane turbine working wheel (8), accomplishing a rotational mechanical work on shaft (9). Together with the active working hydrodynamic flow, the return recirculation flow via the return narrowing curved recirculation channels (4) is also partially achieved, which are arranged from the exit of working wheel (8) towards the periphery and terminating again on directing channels (3). The recirculation flow is necessary because of the flow continuity and the flow energy accumulation, which is not immediately completely converted into the mechanical work. On the cooled side of the thermal hydro-machine the passive (useless) hydrodynamic recirculation flow is achieved, on one side aided by the suction (ejection) effect of the working active flow on the entrance into working wheel (8), and on the other side aided by the suction action of the compression work of the compression cylinders (2) via return widening curved excepting channels (5). Return excepting channels (5) start from the exit of working wheel (8), proceed towards working cylinders (2) and terminate by connecting onto them. In the hot space they are closed by mobile vanes (6) or, alternatively, by axially mobile closers (6'), while in the cooled space they open completely, enabling the exertion flow.

The work of the thermal hydro-machine is possible even without the working pistons (alternatively, without the elastic membranes in the chambers). Then, the working fluid is also in the same time the recirculation medium with two phases. The gaseous phase as a compressible primary component and the liquid phase as the incompressible secondary recirculation component. It is certain, that then the fluid working pressures must be harmonized according to the technical features. Then, the gaseous phase would be achieved in the hot part of the collector or evaporator, and the alternatively cooled part of the collector would serve as the condenser. When the working fluid is a mixture of liquid and vapour, then the process is carried out in the wet (saturated) region with the change of the aggregate state. In the wet region the saturation temperature of the vapour depends on the pressure, so that the isothermal state changes are also isobars in the same time. The evaporation is carried out on the maximum temperature, and the condensation happens on the minimum one.

To enable the automatic conducting of the heat exchanger (1) over the heat source or the cooled space between two characteristic assemblies, relatively turnable assembly I and working turnable assembly II, a mechanical intermediate transmitter is foreseen for accomplishing the auxiliary relative turning in the opposite direction. The mechanical transmitter is disposed on all three assemblies, and it consists of inserted teething (7) in cylinder casing (2), freely driven intermediate gear wheel (11) and driving gear wheel (10) rigidly connected onto working shaft (9) for accomplishing the driving coupling.

When choosing the size of the thermal hydro-machine, the tendencies if possible should be to make the constructions as big as possible. Each bigger thermal machine for the same construction type gives a better efficiency grade at the conversion of the thermal energy into the mechanical work. The size of the thermal hydro-machine at this type of the construction is of special importance, because the velocity of the relative motion of rotational exchanger (1) with segment cylinders (2) must be relatively small (slow) to achieve a predominantly isothermal cycle. This will be easier to achieve with a greater number of segment cylinders (2) on a bigger construction than on a smaller one, because also the size of segment cylinders (2) must have an optimum constructional value. Beside, at the bigger construction the hydrodynamic flow of the recirculation incompressible medium without vorticity is an essential and very serious requirement of all classical hydro-machines, which is actually very good solved today, but this type of the hydro-machine has also some additional requirements due to the particularity of the type construction. Therefore, at the solution of this problem, a special attention must be paid already when making the experimental model. The size of the thermal hydro-machine will depend on the desired power to be achieved. As the power depends proportionally on the volume of working cylinders (2) that take part in the working cycle and on the third power of the working fluid temperature difference in the hot and cooled space, following conclusions yield:

- for greater powers it is necessary to build constructional bigger thermal hydro-machines of greater working volumes with a greater number of segment cylinders (2),
- for a power as great as possible the working fluid temperature difference between the hot and cooled part of the thermal machine must be also as great as possible.

The greater working volumes of the thermal hydro-machine are particularly important for exploiting the low-temperature heat sources, where the temperature differences between the heat source and the cooled space are limited. It should by all means be tried to have a greatest possible temperature difference, so that, at the choice of the hydro-machine size, the optimum according to the given conditions should be found. By increasing the compression ratio of the working pressure of the compressible fluid of the thermal hydro-machine the power will not increase, but the conversion process can be improved. By a greater working pressure the density, i.e. the mass of the working fluid, will increase and by that also its specific heat, so that its ability of the heat accepting or delivering is greater. So, the thermal hydro machine of the same size will be more efficient at greater working pressure ratios and greater compression ratios, because it will better use the heat source and achieve the desired temperature difference with respect to the cooled space. In direct connection with this is the optimisation of the relative motion speed, which can be achieved by the complementary gearbox (variator) and in such a way the state changes of the working cycle, can be optimised.

Working fluid—The working compressible fluid must have a great ability of accepting the heat. Most often this is the gas with a greatest possible specific heat, but also the other technological requirements must be taken into account. So, for example, hydrogen has a several times greater specific heat than the air, but it is unpractical due to the inflammability, therefore the neutral helium with a worse specific heat than hydrogen but a better one than the air is recommended. In an extreme case, the working fluid can also be a liquid of high compressibility and great specific heat. The ordinary water or the hydraulic oil have very good thermal properties, but, due to a low thermal flexibility, very high pressures are necessary, what is not practical because the construction must be more robust. The advantage would be, that then the one-phase working fluid would take over the role also from the recirculation medium, so that no pistons would be necessary, and that would mean another great construction simplification.

Recirculation medium—The work transmitter is the recirculation incompressible medium, which by the hydrodynamic flow accomplishes the secondary assignment of the mechanical work transmitter between the state changes of the compressible working fluid and working wheel (8). Besides, the recirculation incompressible medium accomplishes an essential assignment of the catalyst of the entire heat conversion process into the mechanical work, so that this machine is in that sense hydrodinamically more complicated than the classical hydro-machines. The present hydro-machines have a high hydraulic efficiency grade, so that it is expected that also this construction, at satisfying the specific requirements, by the development in the future would reach the satisfactory level. In such a way, practically it would not substantially decrease the efficiency of the entire real heat conversion process into the mechanical work, which is for this construction type of the thermal hydro-machine extremely convenient from the theoretical aspect.

A special variant of the constructional realisation of the thermal hydro-machine would be, if the working compressible fluid (gas) and the recirculation incompressible medium (liquid) were the same two-component fluid with the vapour and liquid phase This would be the mixture of the liquid and vapour, so that the thermo dynamical process would be performed in a wet, saturated area with the change of the aggregate state. In the wet area the vapour saturation temperature would depend on the pressure, so that the isothermal state changes would be made equal with the isobars. The vapour phase would take over the role of the working compressible fluid, and the liquid phase the secondary role of the recirculation medium. In such a way the hydro-machine on hot mixture would become of even a simpler construction, because working cylinders with pistons (2) would vanish, and rotational heat exchanger (1) would entirely take over their function, which would work as an evaporator in the hot space and simultaneously as a condenser in the cooled space. At the use of the mixture the working pressures and working temperatures must by all means be adjusted according to the technical characteristics in a way that the vapour phase is created in the hot part of the exchanger-evaporator, and, alternatively, the condensate in the cooled part of the exchanger-condenser. The position of the hydro-machine on hot mixture would have to be such, that the exchanger's assembly with the vapour phase at gravitation conditions is always turned upwards, and the hydro-drive with the liquid phase exclusively downwards. But, in the weightless state conditions, for example in space, this condition must not be satisfied.

By the adjusted mechanical closing of excepting return channels (5) in the hot space and by opening excepting return channels (5) in the cooled space it is possible, if necessary, to prevent or alternatively to enable the vortex less flow of the recirculation medium towards segment cylinders (2). The simplest possibility is the adjusted closing of excepting return channels (5) in the hot space or the opening in the cooled space by means of arc-wise driven vanes (6) due to the fore pressure or under pressure of the recirculation medium. Mobile vanes (6) can be fixed on the casing of the entrance itself of excepting return channel (5), or can be alternatively constructed as an independent regulation directed wheel, what is the matter of a further machine improvement. As a less perfect possibility of closing excepting return channels (5) is by means of axially mobile closers (6') firmly connected onto the mobile working pistons, which would gradually close the exits at the expansion, work and open it at the compression.

The thermal hydro-machine could work without limitation, if the heat source and the cooled space would change the roles. If the position of the heat source with respect to rotational heat exchanger (1) would change for any engaging angle, this would follow by all means the changes in the cooled space on the other side of exchanger (1). From that it follows, that the heat source can be mobile and can like a satellite circularly follow heat exchanger (1), which then must not be mobile any more. As in this case heat exchanger (1) is immovable, the mechanical transmitter falls off, and the construction of the thermal hydro- machine is simplified. In such a way the problem of the relative motion is transmitted onto the heat source that must take over the independent mobile role, what can be solved in several ways, like for example, by mobile burners, stable burners that would by alternately activated over the periphery of the exchanger, by directing the flow of the hot air or hot gases, by the steam distributors and alike. The problem of the relative motion of the hydro-machine can be alternatively solved by the reactive flow of the recirculation medium through corresponding, additionally adapted, curved directing and excepting channels on assembly I, also without the mechanical transmitters, what is the matter of a further improvement.

Because of an alternate removing exchanger's assembly (1) from the hot space into the cooled space, the appearance of the characteristically thermal stresses is expected, which intensity will depend on the temperature difference of the hot part and the cooled part. This disadvantage could influence the duration time of exchanger's assembly (1), which should be easily replaceable. By building huge block units with a slow-running relative motion and a lower temperature difference, this disadvantage would not be expressed so much.

Way of Invention Application

The best known way for the commercial use of this invention will be cited through several possibilities. It is a fact that the thermal hydro-machine on hot gas can be universally applied for exploiting the renewable and not-renewable heat sources of all temperature differences, from a small intensity to a great one, which are on disposal in the nature. It can be applied at high pressure ratios of the working gas and at greater compression ratio, as much as the technological possibilities allow that, because it works in the closed space. They can be built of small sizes, but even better are those of greater size till the commercial limits. As the heat is conducted to from the outer side of the exchanger, it can easily be adjusted to any heat source.

The obtained mechanical work on the shaft of the thermal hydro-machine can be directly or indirectly used for the universal propulsion of machines of various assignments, such as, for example, the generators for the electric energy production, the pumps, the street and rail vehicles, the various kinds of lifts and cranes, ships, submarines, propulsion and regulation devices and else.

Solar Energy

If the recycling solar energy would be used, then the thermal hydro-machine would be particularly suitable for the radiation energy acceptance by means of the segment solar collectors that are particularly adjusted to this heat source. One part of the solar collectors would be alternatively hot and the other one alternatively cold, so that by the transient rotational motion about the main shaft with respect to the radiation source they would gradually exchange the places and so the roles as well. In order to retain the collector in the position towards the sun, it is substantially necessary to have at least a simple mechanism for the season's adjustment of the inclination towards the sun. For the university of the thermal hydro-machine, the mechanism for the daily monitoring of the sun would not be necessary, because the hydro-machine would be in full function even at the season's inclination only. This would enable to it the universal replacement of the heat source and cooled space position around the collector, without any influence on the machine work. In case, if a greater increase of the temperature difference of the source and the cooled space (energy intensity) would be demanded, then a concentrator of the solar radiation should be built-in. In that case, the mechanism for the daily sun monitoring would be necessary, to direct the radiation concentrator. Also, in an analogue way, by an additional building of the device for a more intensive cooling on the opposite side, at the heat conducting-away the energy intensity and the machine efficiency would be increased, what would by all means additionally complicate the construction, so the rationality question is a matter of estimation.

Use in Space

The thermal hydro-machine on hot gas in the closed system under pressure would be suitable for using in Space for the need of driving the auxiliary devices or for the production of the electric energy. Because of an intensive solar radiation in Space and the greater temperature differences on the sunny side than in the shadow, a good exploitation is expected. Then, the collector should be adapted only for the heat achieved by radiation, because in Space there is no heat transmission by convection. The universal self-replaceability of the heat source and of the cooled space in relation to the turnable position of the heat exchanger could particularly good be used, without any bad influence on the machine function.

Thermal Energy of the Renewable Sources of the Environment (the Sea, the Air, the River, the Lake or the Geothermal Sources)

The sea is an immense thermal source, but, due to a small temperature difference between the sea and the environment, it cannot be used commercially today. If a sufficiently big hydro-machine on hot gas would be built, which exchanger's assembly would be partially immersed into the sea (for example, one half), while the remaining part of the exchanger's assembly would be above the sea level in the air, the machine could be actuated even at a small temperature difference between the sea and the environment. At the machine actuating, also the relative motion of the exchanger's assembly would immediately start, so that the segment exchanger's units would be alternatively heated or cooled. The thermal hydro-machine could practically work efficiently in summer and in winter due to the universality of the constructional realisation, which enables in any moment a complete position exchange of the heat source and the cooled space with respect to the exchanger's assembly. To actuate the thermal hydro-machine, only the sufficient temperature difference between the sea and the environment is necessary. So, for example in the winter, when the sea temperature is higher than the surrounding air, the sea thermal energy would be used and the air would be the cooled space. In summer, when the sea temperature is lower, the surrounding air would be the heat source and the sea the cooled space. The alternative use in the summer period could be additionally combined with the solar heating, as it was already described.

In such a way the thermal hydro-machine could be used in the daytime, at night, in winter, summer, always when there exists the temperature difference individually or in a special case, as a modular construction. Because of an easy actuating and stopping, it would be suitable as a peak electric power without special preparations, which are usually necessary at the classical solutions on conventional fuel.

Waste Industrial Heat

By means of the thermal hydro-machine on hot gas all kinds of sources of low-temperature waste heat can be exploited regardless of the way they were created, because the temperature is conducted to from the outer side of the collector. It is always necessary to adapt the collector exchanger's assembly to the heat source or to the cooled space. At that it is not important at which side of the hydro-machine the heat is conducted to and at which side conducted away due to the mentioned universally of the constructional realisation, so that it can work without any special preparation in all conditions.

Generally, this universality opens a broad field of application without special preparations and additional service that is usually necessary at classical constructions, particularly at the exploitation of the waste heat. In an extreme case the heat source can take over the relative motion instead of the exchanger's assembly, and the waste heat can be directed in a way that the exchanger becomes one moment hot, one moment cold with the same effects.

Heat from the Recyclable and Not-recyclable Fuels (Gaseous and Liquid Hydrocarbons, Wood, Biomasses, Vapours, Hot Air and Else)

A special case of the heat conducting-to on the cylinders, or alternatively in the cylinders on the hot side, is possible by means of the turnable distributor of hot steam or air and of the system of directed non-return valves from the accumulating container. It is also possible to get the heat by the combustion of gaseous or liquid hydrocarbons, which combustion products would be introduced into the cylinders, for example directly before the expansion phase, similarly like at the internal combustion engines. The discharge of the cooled combustion products would be carried out also via the non-return valves in the most convenient position and cycle instant, for example before the begin of the compression phase., The thermodynamic cycle would then certainly transform into the corrected new form. In such a way, this possibility could replace the classical internal combustion engines or the gas turbines with a much better heat exploitation. For the propulsion on steam, the combustion of the biomasses, straw or burning waste of any kind in the boiler rooms would be possible, and the obtained heat could be used better and more efficiently than in the present turbines.

The invention claimed is:

1. A thermal hydro-machine for conversion of heat energy into mechanical work comprising:

(a) a first assembly comprising:

(i) a rotational heat exchanger comprising a set of interconnected segment collectors arranged in the form of a cylinder's shell, wherein the interconnected segment collectors are capable of receiving heat and are capable of delivering heat depending on the position of the segment collectors relative to a heat source or cooled space when a compressible medium or working gas is under pressure;

(ii) a set of working segment cylinders with free pistons or a set of working segment chambers with an elastic membrane, wherein said set of working segment cylinders with free pistons or said set of working segment chambers with an elastic membrane are connected and functionally paired with said segment collectors, and wherein when said compressible medium or said working gas is under pressure the compressible medium or the working gas fills the set of working segment cylinders with free pistons or the set of working segment chambers and it fills said segment collectors;

(iii) directed narrowed-down curved channels that directly connect said working segment cylinders or said working segment chambers with a working vane wheel, thereby directing and accelerating an incompressible medium or liquid in a concentrated way toward the center of said working vane wheel;

(iv) return widening curved channels for the recirculation of said incompressible medium or liquid, wherein said return widening curved channels are directly connected with said directed channels and with said working vane wheel;

(v) return widening curved channels for abstracting said incompressible medium or liquid, wherein said return widening curved channels are directly connected with said working segment cylinders or with said working segment chambers and are directly connected with said working vane wheel;

(vi) arch wise mobile vanes for closing and opening of said return widening curved channels for abstracting of said incompressible medium or liquid, or axially mobile closers with the capability for a two-direction axial motion for the closing and opening of an exit of said return widening curved channels for abstracting of said incompressible medium or liquid, which are firmly fastened on the free pistons in said segment cylinders or on the mobile elastic membranes in said segment chambers; and (vii) inserted transmitter on a casing of said first assembly;

(b) a second assembly comprising:

(i) a working shaft that is freely embedded on said casing of said first assembly and a machine stand, wherein said working vane wheel is firmly fastened or wedged on said working shaft and wherein a hydrodynamic flow energy of said incompressible medium or liquid converts into the rotational mechanical work;

(ii) a driving transmitter of the relative motion, wherein the driving transmitter is firmly fastened or wedged on said working shaft and coupled with a driven pair of intermediate transmitters; and (iii) a generator's rotor that is firmly fastened or wedged on said working shaft; and (c) a third assembly comprising:

(i) said driven pair of intermediate transmitters, wherein said driven pair of intermediate transmitters are placed coaxially with respect to said working shaft and freely embedded on the shaft of an embracing carrier;

(ii) said embracing carrier, wherein said embracing carrier is freely embedded on said machine stand; and (iii) said machine stand to which the casing or a stator of said generator is firmly fastened.

2. The thermal hydro-machine according to claim 1 wherein said compressible medium or working gas is heated by conduction of heat via a first portion of the rotational heat exchanger in a hot space and in the same time cooled by conduction of heat to a second portion of the rotational heat exchanger in the cooled space, thereby enabling in said working segment cylinders or in said working segment chambers a real, continuous, reversible and unique right-turning, circular thermodynamic cycle for the conversion of the thermal energy into the mechanical work, wherein said cycle comprises:

an isothermal compression from state one to state two;

an isobaric expansion from state two to state three;

an isothermal expansion from state three to state four; and an isochoric heat conducting from state four to state one.

3. The thermal hydro-machine according to claim 1, wherein said first assembly accomplishes a first rotational motion and said second assembly accomplishes a second rotational motion, wherein said first rotational motion is slower than said second rotational motion.

4. The thermal hydro-machine according to claim 3, wherein said driving transmitter of the second assembly, said driven pair of intermediate transmitters of the third assembly and the inserted transmitters of the third assembly are coupled to one another.

5. The thermal hydro-machine according to claim 1 further comprising an adjustable catalytic hydrodynamic connection between a hot and cooled part of the machine that enables functioning without a significant time phase shift between a set of expansions and a set of compressions of the compressible medium or working gas.

6. The thermal hydro-machine according to claim 1, wherein said return widening curved channels start at an exit of said working vane wheel and are wider arch wise toward said directed channels on the periphery.

7. The thermal hydro-machine according to claim 1, wherein said return curved channels for exertion of recirculation of the incompressible medium or liquid start at an exit of said working vane wheel and get wider arch wise toward said working segment cylinders or, alternatively, toward said working segment chambers, wherein their exertion function is determined by the relative position with respect to the cooled space.

8. The thermal hydro-machine according to claim 1, wherein said arch wise mobile vanes on the entrance of said return abstracting channels open said return abstraction channels accomplishing the abstraction of a part of said recirculation incompressible medium or liquid towards a cooled part of the machine for filling-up of an emptied space in an amount that is pressed out from a hot part of the machine.

9. The thermal hydro-machine according to patent claim 1, wherein said axially mobile closers for closing the exits of said return abstracting channels in a hot part of the machine or for opening the exits of said return abstracting channels in a cooled part of the machine are rigidly fastened on the free pistons in said working segment cylinders or alternatively, are rigidly fastened on elastic membranes in said working segment chambers, thereby enabling the abstraction of a part of the recirculation incompressible medium or liquid toward the cooled part of the machine for the filling-up of an emptied space in an amount that is pressed out from the hot part of the machine.

* * * * *